United States Patent [19]

Zöllner nee Möller et al.

[11] 3,992,280

[45] Nov. 16, 1976

[54] METAL ELECTRODE WITH AN ACTIVE COVER LAYER FOR ELECTROCHEMICAL PURPOSES

[75] Inventors: Christine Zöllner nee Möller; Dieter Zöllner, both of Schwaig near Nurnberg; Konrad Koziol, Rothenbach a.d. Pegnitz, all of Germany

[73] Assignee: C. Conradty, Nurnberg, Germany

[22] Filed: Oct. 22, 1974

[21] Appl. No.: 516,951

[30] Foreign Application Priority Data

Oct. 31, 1973 Germany ..... 2354477

[52] U.S. Cl. ..... 204/290 F

[51] Int. Cl.[2] ..... C25B 11/06; C25B 1/34; C25B 11/10

[58] Field of Search ..... 204/290 F

[56] References Cited

UNITED STATES PATENTS

| | | | |
|---|---|---|---|
| 3,689,383 | 9/1972 | DeWitt | 204/95 |
| 3,706,644 | 12/1972 | Martinson | 204/98 |
| 3,711,397 | 1/1973 | Martinsons | 204/290 F |
| 3,846,273 | 11/1974 | Bianchi et al. | 204/290 F |

FOREIGN PATENTS OR APPLICATIONS

| | | | |
|---|---|---|---|
| 1,164,477 | 9/1969 | United Kingdom | 204/290 F |

*Primary Examiner*—F.C. Edmundson

*Attorney, Agent, or Firm*—Gifford, Chandler, Sheridan & Sprinkle

[57] ABSTRACT

A metal electrode with an active cover layer for electrochemical purposes which cover layer includes metal platinates, metal palladates, or the like, and metal palladates and comprises, as embedding substances compounds of the type Ba $(M_xTi_{1-x})O_3$ where M is a platinum metal. The latter may be used alone or in combination with other additives and does not impair on the one hand the effectiveness of the active materials and is on the other hand, when exposed to an electrolytic bath, location in chemically resistant without showing complete inactivity and, thus, increase the current yield of the anode.

5 Claims, No Drawings

METAL ELECTRODE WITH AN ACTIVE COVER LAYER FOR ELECTROCHEMICAL PURPOSES

BACKGROUND OF THE INVENTION

The present invention relates to a metal electrode with an active cover layer comprising metal platinates, metal palladates, or the like.

It is known in the art to utilize metal electrodes with an active cover layer on the basis of Me(I) approx. $0.5Pt_3O_4$, with Me(I) representing Li and Na for the electrolyses of NaCl, KCl, chlorate and HCl, as shown by the German published application No. 1,813,944. As shown by U.S. application Ser. No. 450,834, the active cover may also contain substances of the type $Me_A$(I) approx. $0,4Me_B$(I) approx. $0,1Pt_3O_4$, with $Me_A$ representing Li, Na, K and $Me_B$ representing Tl and Ag. These electrodes stand out for a high reliability in operation, long life and high constancy of the cell voltage.

DESCRIPTION OF THE INVENTION

It is, therefore, an object to be solved by the invention to provide an embedding material for these metal electrodes positioned between the alloyed-on-surface of the carrier member of the electrode, consisting i.e. of titanium, and the above mentioned electrochemically active substances.

It is a further object of the invention to provide an embedding material between the alloyed-on-surface of the carrier member and the electrochemically active substances, which embedding material does not impair the effectiveness of the active materials.

According to a further object of the invention the embedding material between the alloyed-on surface of the carrier member of the electrode and the electrochemically active substances should, in areas where it is exposed, protect the electrode in a chemically resistant manner without showing complete inactivity, in order to increase the current yield of the anode.

According to the invention, this problem is solved by the use of compounds of the type Ba $(M_xTi_{1-x})O_3$ alone or in combination with other additives, as embedding substances to constitute the cover layer. These compounds have been prepared in pure forms and examined for the first time by J. G. Dickson, L. Katz and R. Ward (J. Am. Chem. Soc. 83, page 3026, 1961).

It turned out that these compounds quite well embed the active compounds Me(I) approx. $0.5Pt_3O_4$ and $Me_A$(I) approx. $0.4Me_B$ (I) approx. $0,1Pt_3O_4$ and also adhere very well to the alloyed-on titanium surface of the electrode carrier member. In contrast to many other co-adhesives, these substances also show a specific electrical conductivity and, though small, an electrochemical activity.

EXAMPLE 1

1 Mol $BaCO_3$, 0.1 Mol $PtO_2$, 0.9 Mol $TiO_2$ each are finely ground and are heated for about 1 hour in air in a silica crucible, the sinter material is again finely ground and in the course of 24 hours is under vacuum brought to 1300° C. A homogeneous, micro-crystalline, amber compound is obtained. This compound (70%) is sintered together with $Li_{0,5}Pt_3O_4$ (30%) to platinized-on titanium at approx. 600° C. In extreme cases, the content of $Li_{0,5}Pt_3O_4$ can be lowered for the electrochemical use down to 10%, but normally a proportionate amount of about 40% is preferred. The thus obtained electrode showed current yields of 97–98 %.

The reaction is conducted according to the following equation:

$$BaCO_3 + 0.1\ PtO_2 + 0.9\ TiO_2 \xrightarrow{1000^\circ - 1300^\circ C} Ba(Pt_{0.1}Ti_{0.9})O_3 + CO_2.$$

It is not expedient to use values below 0.1 Mol $PtO_2$, because otherwise the pure barium titanate is already present, which shows much too low a chemical activity and too poor electrical conductivity. At values of 0.1–0.5 $PtO_2$ in the compound a complete reaction is no longer taking place and, simultaneously with the compound formation, decomposition of the $PtO_2$ takes place, wherein metallic platinum is set free which makes the compound impure. This is of advantage for the burning-in process of the titanium surface, so that it is preferred to operate within this range. In the compound group Ba $(M_xTi_{1-x})O_3$, Ru, Rh, Pd, Os, Ir may be used as metals.

It can be considered an example for the preparation:

$$0.3\ Ru + BaCO_3 + 0.7\ TiO_2 + 0.3\ O_2 \xrightarrow{approx.\ 1100^\circ C} Ba(Ru_{0.3}Ti_{0.7})O_3 + CO_2$$

EXAMPLE 2

0.3 Mol Ru, 1 Mol $BaCO_3$ and 0.7 Mol $TiO_2$ are slowly heated in finest powdered form to 1050°–1100° C in air in a silica crucible. Small, almost colourless crystals result. They are applied together with a mixture of 30 % $Li_{0.5}$ $Pt_3O_4$, 5 % $Na_{0.4}$ $Tl_{0.1}Pt_3O_4$ and 5 % $Li_{0.5}Ag_{0.1}Pt_3O_4$ onto a titanium surface alloyed with thallium. The cell voltage at 10.000 A/m² amounts to 4.3 V, the electrodes so far have operated in the NaCl-cell for 15 months without difficulties.

A particular variation of the combination of active substance of the cover layer and embedding material of the invention consists in selecting in the embedding material the same precious metal component as in the active substance. If, for example, $Li_{0.5}Pt_3O_4$ is used as active substance, $Ba(Pt_{0.2}Ti_{0.8})O_3$ may be used as embedding material. If the active component consists of $TlPd_3O_4$, then $Ba(Pd_{0.25}Ti_{0.75})O_3$ may be used as embedding material.

Also the embedding material may be selected such that the doping component of the titanate consists of the metal that is also alloyed into the surface of the electrode carrier member consisting of titanium. For example Pt, Rh, Pd and Ir come into consideration therefor.

It has also turned out expedient to use the same precious metal component for the embedding substance, the active substance and the alloy of the surface of the electrode carrier member consisting of titanium.

It is, of course, to be understood that the present invention is, by no means, limited to the particular examples, but also comprises any modifications within the scope of the appended claims.

What is claimed is:

1. In an electrode for use in an electrolytic bath wherein said electrode comprises a basis metal and an active cover layer comprising a compound selected from the group consisting of a metal platinate and a metal palladate, the improvement which comprises an embedding layer between said basis metal and said cover layer, said embedding layer serving to secure said cover layer to said basis metal and said embedding layer comprising a compound having the formula Ba $(M_X Ti_{1-X}) O_3$ wherein M is at least one element selected from the group consisting of Pt, Ru, Rh, Pd, Os, and Ir, and wherein X is a number between about 0.1 and about 0.5.

2. An electrode as defined in claim 1 wherein said active cover layer compound is a metal platinate.

3. An electrode as defined in claim 1 wherein said active cover layer compound is a metal palladate.

4. An electrode as defined in claim 1 wherein M is ruthenium.

5. An electrode as defined in claim 1 wherein M is platinum.

* * * * *